US007766401B2

(12) United States Patent
Costigan

(10) Patent No.: US 7,766,401 B2
(45) Date of Patent: Aug. 3, 2010

(54) ROD SET CLIP FOR VEHICLE DOOR

(75) Inventor: Terrence P. Costigan, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/745,485

(22) Filed: May 8, 2007

(65) Prior Publication Data

US 2008/0277947 A1 Nov. 13, 2008

(51) Int. Cl.
*E05B 65/20* (2006.01)

(52) U.S. Cl. ..... 292/336.3; 292/DIG. 64; 292/DIG. 53

(58) Field of Classification Search ..... 292/100, 292/DIG. 64, DIG. 53, 256, 307 R, 317–324, 292/307 B; 403/12; 24/16 PB; 401/141, 401/344, 322.1, 330; 411/182, 508, 913, 411/433, 539–541; 248/222.13, 222.51, 248/220.21, 227.4
See application file for complete search history.

(56) References Cited

U.S. PATENT DOCUMENTS 4,439,896 A * 4/1984 Matsui ..... 24/16 PB
5,407,289 A * 4/1995 Pebre ..... 403/252
5,469,663 A * 11/1995 TenBrink et al. ..... 49/375
5,492,379 A * 2/1996 Staser et al. ..... 292/336.3
5,548,929 A * 8/1996 Larsen et al. ..... 49/441
6,514,027 B1 * 2/2003 Yiu et al. ..... 411/433
6,644,713 B2 * 11/2003 Del Pozo Abejon et al. ..... 296/39.1
6,962,470 B2 * 11/2005 Anscher ..... 411/433
7,175,209 B2 * 2/2007 Cetnar et al. ..... 292/100
7,175,211 B2 * 2/2007 Cetnar et al. ..... 292/216
7,303,224 B2 * 12/2007 Kim ..... 296/76

FOREIGN PATENT DOCUMENTS

DE 3145421 A1 6/1982
DE 8600443 U1 4/1986
DE 19925859 B4 6/2008
EP 1160402 A1 * 12/2001
WO 2006/074632 A1 7/2006

* cited by examiner

*Primary Examiner*—Peter M. Cuomo
*Assistant Examiner*—Mark Williams

(57) ABSTRACT

A latch set clip for use with a vehicle door and method of assembly are disclosed. The latch set clip may include a clip main body that mounts to a latch lever of a door latch assembly and a clip pivoting body that, with the main body, secures a lever rod to the latch set clip. The latch set clip may allow for components of a latch/window regulator module to be assembled before assembly into the vehicle door.

13 Claims, 3 Drawing Sheets

ROD SET CLIP FOR VEHICLE DOOR

BACKGROUND OF THE INVENTION

The present application relates generally to a vehicle door, and more particularly to a vehicle door having a movable window glass and an outside door handle.

For vehicle doors with a movable window glass, there are typically separate mechanisms for guiding the window glass and for controlling the movement of the glass. A pair of glass run channels mount inside the door near either end and receive and guide the window glass. A pair of window regulator guide rails are typically mounted between the run channels and are part of the system for controlling the up and down movement of the window glass. More recently, some have proposed integrating the glass run channels and guide rails. While this may have some cost and operational advantages, it also can make the door assembly process more difficult.

For example, on side doors, door latches are typically located and secured to the door inner panel, while outside door handles are typically located and secured to the door outer panel. Most vehicles transfer the opening energy from the outside door handle to the latch via a rod. And, in order to minimize outside handle travel and efforts the rod must be adjusted so that there is very little or no play in the system. This is typically achieved with a set clip that attaches the rod to the door latch. One characteristic of the set clip with these conventional configurations is that the set clip is closed prior to installation of the rear below belt glass run channel. This is easily accomplished by the installation process for a conventional layout of components in the door. But with an integrated glass run channel and guide rail, a corresponding new assembly process is generally required for the integrated components. With the new assembly process for the integrated components, the conventional set clip is inaccessible behind the channel. The integration inherently provides less room for an assembler to maneuver a hand inside the door to secure components together. Thus, it would be difficult for one assembling components in the door to not only assure that the set clip is closed properly but that the play in the system is minimized. It would also be difficult for an assembler to see if the set clip is twisted or account for threads on the clip that engage the rod prematurely, which adds to the difficulty of assuring that the set clip is properly closed.

SUMMARY OF THE INVENTION

An embodiment contemplates a latch set clip for securing a lever rod to a latch lever of a door latch assembly. The latch set clip may comprise a clip main body and a clip pivoting body. The clip main body may include a clip mounting flange mountable on the latch lever, a hinge support, and a pivoting body catch located adjacent to the clip mounting flange. The clip pivoting body may include a hinge pivotally engaged with the hinge support, a surface engageable with the lever rod when the clip pivoting body is in a closed position relative to the clip main body, a finger latching extension in opposed relation to the hinge for moving the clip pivoting body into the closed position relative to the clip main body, an engagement flange having a barb that is releasably engageable with the pivoting body catch in the closed position, and a servicing tab extending from the engagement flange such that a force exerted on the servicing tab will release the barb of the engagement flange from the pivoting body catch when the clip pivoting body is in the closed position.

An embodiment contemplates a door for a vehicle. The vehicle door may comprise a rear integrated channel/regulator mounted to the door including a glass run channel, a door latch assembly mounted to the integrated channel/regulator including a latch lever, a lever rod having a first end and an opposed second end, and a latch set clip, secured to the lever rod adjacent to the first end, including a clip main body and a clip pivoting body, the clip main body having a clip mounting flange mounted on the latch lever and a hinge support, and the clip pivoting body having a finger latching extension including a free end that extends in an outboard direction of the door outboard of the glass run channel, and a hinge in opposed relation to the free end, the hinge being engaged to the hinge support.

An embodiment contemplates a method of assembling a vehicle door comprising the steps of: mounting a door latch assembly onto a rear glass run channel of a rear integrated channel/regulator to form a latch/window regulator module; assembling a clip main body of a latch set clip to a latch lever of the door latch assembly; mounting a first end of a lever rod into a lower support loop and an upper support loop of the latch set clip; mounting a second end of the lever rod into a handle lever of an outside door handle chassis; inserting the latch/window regulator module through an access hole in a door inner panel of the vehicle door; securing the latch/window regulator module to the door inner panel; adjusting the lever rod relative to the latch set clip; and pivoting a finger latching extension of a clip pivoting body of the latch set clip to engage the clip pivoting body with the clip main body in a closed position to thereby fix the lever rod relative to the latch set clip.

An advantage of an embodiment is that, after inserting the rear integrated channel/regulator into the door, the latch set clip is easily accessible by an assembly operator, who can reach around the integrated channel/regulator and properly close the set clip. Moreover, support loops on the latch set clip retain the outside handle lever rod in a desired position, while preventing rod-to-clip thread engagement until the latch set clip is closed. Thus, proper assembly is readily assured.

An advantage of an embodiment is that, should the set clip or handle lever rod need to be removed or adjusted during vehicle servicing, the servicing release flange allows for simple and quick release of the set clip.

DETAILED DESCRIPTION

Figure 1:
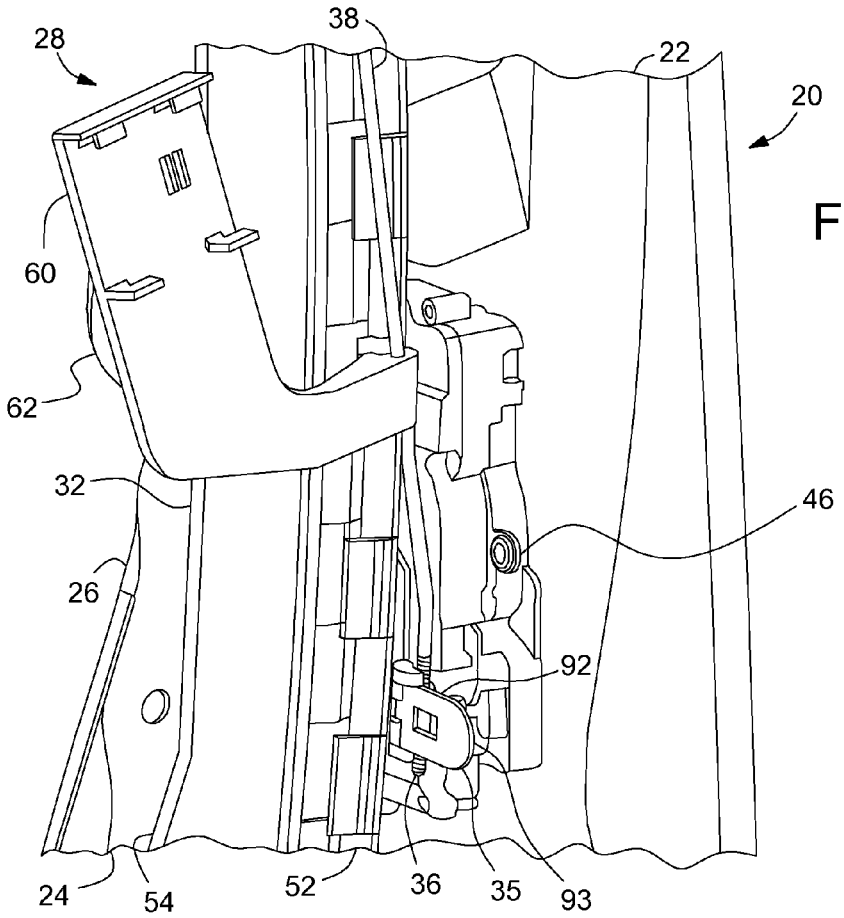
FIG. 1 is a perspective view of a portion of a vehicle door.
Figure 2:
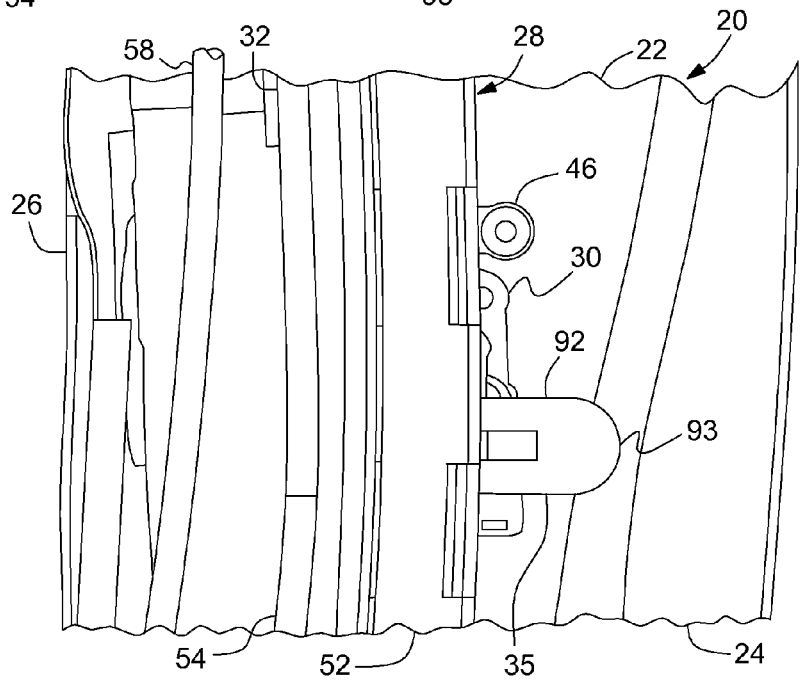
FIG. 2 is an elevation view of a portion of the vehicle door.
Figure 3:
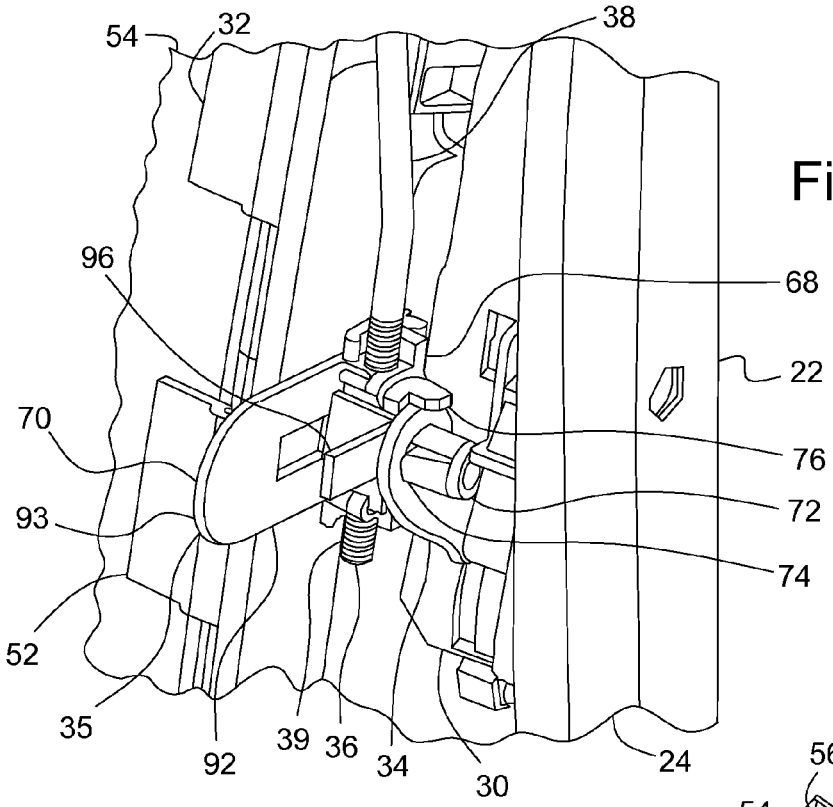
FIG. 3 is a perspective view of a portion of a latch/window regulator module mounted to a door inner panel.
Figure 4:
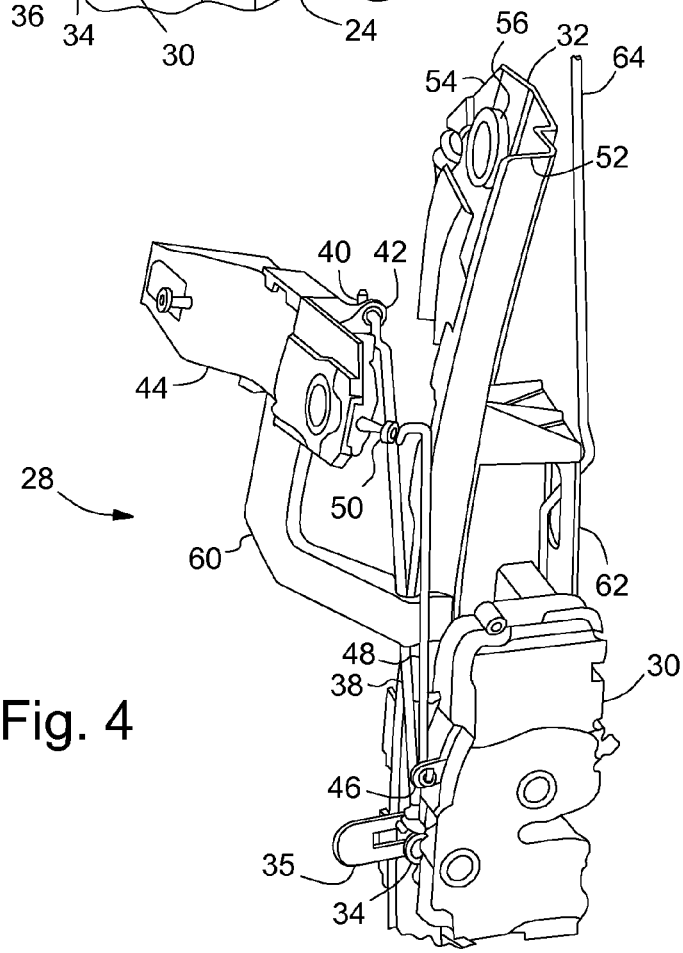
FIG. 4 is a perspective view of a portion of the latch/window regulator assembly.
Figure 5:
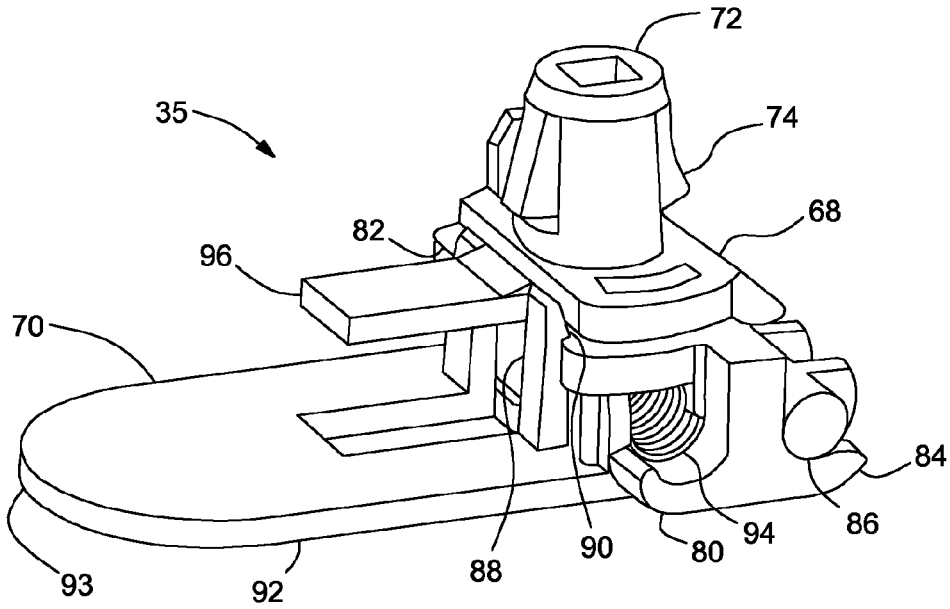
FIG. 5 is a perspective view of a latch set clip in a closed position.
Figure 6:
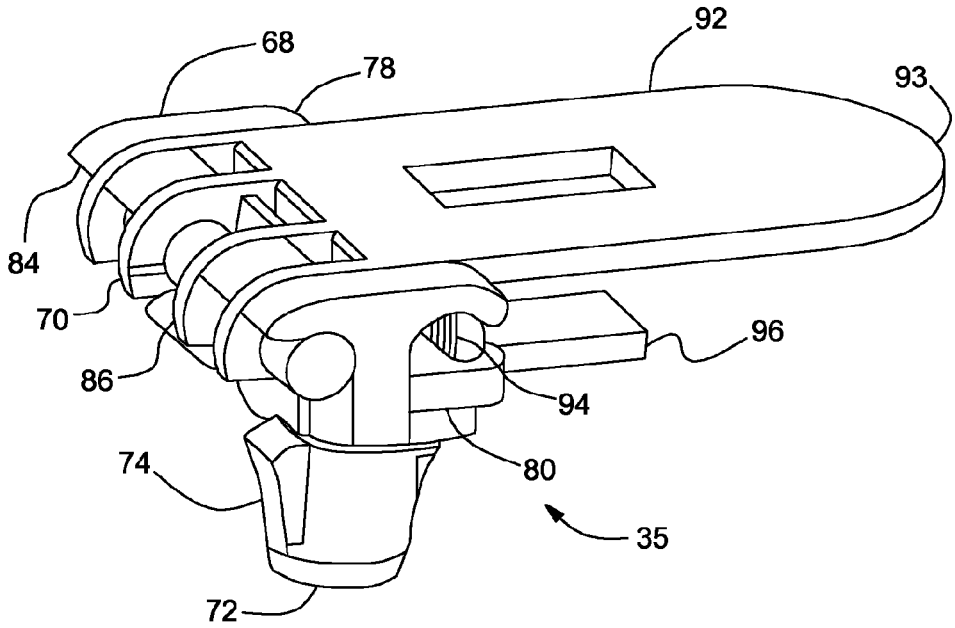
FIG. 6 is a perspective view of the latch set clip of FIG. 5, viewed from a different direction.

FIGS. 1-6 illustrate portions of a vehicle door 20 having a door inner panel 22. The door inner panel 22 includes structure forming a lower door portion 24 that defines an access hole 26. The access hole 26 allows various components and sub-assemblies, such as a latch/window regulator module 28, to be assembled into the door 20.

The latch/window regulator module 28 includes a door latch assembly 30 mounted to a rear integrated channel/regulator 32, which is mounted to the door inner panel 22. The door latch assembly 30 includes a latch lever 34 to which a latch set clip 35, discussed below, is mounted. A first end 36 of an outside handle lever rod 38 includes threads 39 and is connected to the latch set clip 35, and a second end 40 connects to a handle lever 42 on an outside handle door chassis 44 (shown in FIG. 4). The door latch assembly 30 may also include a lock lever 46 to which a lock rod 48 (shown in FIG. 4) is attached, which, in turn, attaches to a key cylinder lever 50 (shown in FIG. 4) on the chassis 44.

The rear integrated channel/regulator 32 has various portions that, while being mostly formed from an integral piece, perform different functions within the door 20. Preferably, the integrated channel/regulator 32 is a molded plastic part, allowing the various portions to be formed integrally. The term integral, as used herein, means that the particular elements are formed as a single monolithic piece rather than being formed separately and later assembled and secured together.

The rear integrated channel/regulator 32 may include a rear below belt glass run channel 52 that is integral with and extends from a window regulator guide rail 54. A top rear pulley 56 and bottom rear pulley (not shown) may mount to the guide rail 54 and guide a cable (not shown)—part of a window regulator cable assembly 58 (shown in FIG. 1)—that controls the vertical movement of a window glass (not shown). An integral outside door handle support flange 60 may extend from the glass run channel 52 and support the outside door handle chassis 44. Also, an integral locking rod flange 62 may extend from the window regulator guide rail 54 and support a vertical locking rod 64 (shown in FIG. 4).

As mentioned above, the latch set clip 35 secures the first end 36 of the outside handle lever rod 38 to the latch lever 34. The latch set clip 35 is made up of two parts—a clip main body 68 and a clip pivoting body 70. The main body 68 has a clip mounting flange 72, with barbs 74 extending therefrom, and a lever contact flange 76. The clip mounting flange 72 is shaped to allow it to slide into the latch lever 34 until the barbs 74 snap into place, securing the main body 68 to the latch lever 34. In the installed position, the lever contact flange 76 also rests against the latch lever 34. The main body 68 also includes an upper support loop 78 and a lower support loop 80 at either end of the main body 68. A pivoting body catch 82 extends along the main body 68 adjacent to the clip mounting flange 72. The main body 68 also includes hinge supports 84, extending in a direction generally opposite from the support loops 78, 80.

The pivoting body 70 includes a hinge 86 that snaps into the hinge supports 84. The pivoting body 70 also includes a pair of catch flanges 88 with barbs 90 that engage with the pivoting body catch 82 to hold the latch set clip 35 in its closed position (shown in FIGS. 1-4). A finger latching extension 92 extends outward away from the hinge 86 a distance sufficient enough to allow a door assembler to easily reach through the access hole 26, around the rear integrated channel/regulator 32, contact the finger latching extension 92 near its free end 93, and snap the clip pivoting body 70 closed against the clip main body 68. This generally means that the free end 93 will extend outboard of the glass run channel 52. Between the hinge 86 and the finger latching extension 92 is a threaded surface 94 that engages with the threads 39 on the outside handle lever rod 38 when the latch set clip 35 is in its closed position.

A servicing release flange 96 is mounted between and extends outward from the catch flanges 88 so that pushing on the flange 96 will bend the catch flanges 88, causing the barbs 90 to disengage from the pivoting body catch 82. This allows the clip pivoting body 70 to pivot to an open position relative to the clip main body 68.

The latch/window regulator module 28, with the rear integrated channel/regulator 32, allows for pre-assembly of some components before assembly into the door inner panel 22. The door latch assembly 30 and the outside door handle chassis 44 may be mounted to the rear integrated channel/regulator 32. The clip mounting flange 72 of the latch set clip 35 may be mounted to the latch lever 34 of the door latch assembly 30. The second end 40 of the outside handle lever rod 38 may be connected to the handle lever 42 of the outside door handle chassis 44, and the first end 36 of the rod 38 may be snapped into the upper and lower support loops 78, 80. With the clip pivoting body 70 still open, the first end 36 of the rod 38 will be maintained in the correction position by the support loops 78, 80, but still allow for up and down sliding for adjustment prior to closing the set clip 35. The window regulator cable assembly 58 and other window regulator components (not shown), as well as any seals (not shown) or other components for the rear glass channel 52, may also be pre-assembled to the rear integrated channel/regulator 32. These pre-assembled components, then, may be inserted through the access hole 26 and secured to the door inner panel 22.

After the connection of an outside door handle (not shown) to the outside handle door chassis 44, the outside handle lever rod 38 may be adjusted in the latch set clip 35 to minimize any play. Then, the assembler may reach through the access hole 26 and around the rear integrated channel/regulator to press on the finger latching extension 92, closing the clip pivoting body 70 against the clip main body 68. As this occurs, the threaded surface 94 on set clip 35 engages the threads 39 on the rod 38 to fix their positions relative to each other, and the barbs 90 on the flanges 88 engage the lever contact flange 76 to hold the set clip 35 in its closed position.

The particular embodiment discussed in detail herein refers to a rear integrated channel/regulator 32. However, as an alternative, the rear glass channel for guiding the window and the rear window regulator guide rail may be separate components (a more conventional arrangement not shown herein), with the door latch assembly 30, set clip 35 and outside handle lever rod 38 still pre-assembled before being assembled into the door 20. The latch set clip 35 with the features described herein may still provide advantages, then, during assembly of the vehicle door 20. Thus, when referring to a rear integrated channel/regulator herein, this may also include a rear glass run channel used in a vehicle door.

While certain embodiments of the present invention have been described in detail, those familiar with the art to which this invention relates will recognize various alternative designs and embodiments for practicing the invention as defined by the following claims.

What is claimed is:

1. A latch set clip for securing a lever rod to a latch lever of a door latch assembly, the latch set clip comprising:

a clip main body including a clip mounting flange mountable on the latch lever, a hinge support, and a pivoting body catch located adjacent to the clip mounting flange; and a clip pivoting body including a hinge pivotally engaged with the hinge support, a surface engageable with the lever rod when the clip pivoting body is in a closed position relative to the clip main body, a finger latching extension in opposed relation to the hinge for moving the clip pivoting body into the closed position relative to the clip main body, an engagement flange having a barb that is releasably engageable with the pivoting body catch in the closed position, and a servicing tab extending from the engagement flange such that a force exerted on the servicing tab will release the barb of the engagement flange from the pivoting body catch when the clip pivoting body is in the closed position;

and wherein the clip pivoting body includes a second engagement flange, spaced from the engagement flange and having a second barb that is releasably engageable with the pivoting body catch in the closed position, the servicing tab located between the engagement flange and the second engagement flange.

2. The latch set clip of claim 1 wherein the surface of the clip pivoting body is a threaded surface that is threadably engageable with the lever rod when the clip pivoting body is in the closed position.

3. The latch set clip of claim 1 wherein the clip main body includes an upper support loop and a lower support loop, spaced from the upper support loop, the upper and lower support loops telescopically slidably engageable with the lever rod.

4. The latch set clip of claim 3 wherein the surface is located between the upper and lower support loops.

5. The latch set clip of claim 1 wherein the clip mounting flange is cylindrical and includes a snap-in barb extending radially therefrom that is engageable with the latch lever to retain the clip mounting flange to the latch lever.

6. The latch set clip of claim 1 wherein the clip main body includes a lever contact flange, extending parallel to and spaced from the clip mounting flange, the lever contact flange being engageable with the latch lever.

7. A door for a vehicle comprising:

a rear integrated channel/regulator mounted to the door and including a glass run channel;

a door latch assembly mounted to the rear integrated channel/regulator and including a latch lever;

a lever rod having a first end and an opposed second end; and a latch set clip, secured to the lever rod adjacent to the first end, including a clip main body and a clip pivoting body, the clip main body having a clip mounting flange mounted on the latch lever, a hinge support and a pivoting body catch located adjacent to the clip mounting flange, and the clip pivoting body having a finger latching extension including a free end that extends in an outboard direction of the door outboard of the glass run channel, a hinge in opposed relation to the free end, the hinge being engaged to the hinge support, a first and a second engagement flange each having a barb that is releasably engageable with the pivoting body catch when the latch set clip is in a closed position, and a servicing tab extending from the engagement flange between the first and second engagement flanges such that a force exerted on the servicing tab will release the barbs of the first and second engagement flanges from the pivoting body catch.

8. The door of claim 7 wherein the clip main body includes an upper support loop slidably engaging the lever rod.

9. The door of claim 8 wherein the clip main body includes a lower support loop, spaced from the upper support loop and slidably engaging the lever rod.

10. The door of claim 9 wherein the first end of the lever rod includes threads and the clip pivoting body includes a threaded surface, located between the upper and lower support loops, that is engaged with the threads when the latch set clip is in a closed position.

11. The door of claim 7 wherein the first end of the lever rod includes threads and the clip pivoting body includes a threaded surface that is engaged with the threads when the latch set clip is in a closed position.

12. The door of claim 7 wherein the clip mounting flange is cylindrical and includes a snap-in barb extending radially therefrom that is engageable with the latch lever to retain the clip mounting flange to the latch lever.

13. The door of claim 7 wherein the clip main body includes a lever contact flange, extending parallel to and spaced from clip mounting flange, the lever contact flange operatively engaging the latch lever.

* * * * *